US006491199B2

(12) United States Patent
Wohlwend et al.

(10) Patent No.: US 6,491,199 B2
(45) Date of Patent: Dec. 10, 2002

(54) SETTING TOOL

(75) Inventors: Norbert Wohlwend, Nendeln (LI); Dionys Schalbetter, Haag (CH); Johann Büchel, Sevelen (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/075,408

(22) Filed: Feb. 13, 2002

(65) Prior Publication Data

US 2002/0113110 A1 Aug. 22, 2002

(30) Foreign Application Priority Data

Feb. 16, 2001 (DE) ..... 101 07 890

(51) Int. Cl.[7] ..... B25C 1/14
(52) U.S. Cl. ..... 227/10; 227/9
(58) Field of Search ..... 227/9, 10, 11; 89/1–14, 35.01, 35.02, 26

(56) References Cited

U.S. PATENT DOCUMENTS 4,114,792 A * 9/1978 Pomeroy ..... 227/10
5,363,736 A * 11/1994 Huang ..... 227/11
5,429,291 A * 7/1995 Thompson ..... 227/10
5,829,661 A * 11/1998 Hirtl et al. ..... 227/10
6,062,455 A * 5/2000 Giannuzzi et al. ..... 227/9
6,126,055 A * 10/2000 Gantner et al. ..... 227/10

* cited by examiner

*Primary Examiner*—Scott A. Smith
(74) *Attorney, Agent, or Firm*—Sidley Austin Brown & Wood, LLP

(57) ABSTRACT

A setting tool comprised of a housing (1), a handle (2), an axially displaceable firing device (10), an axially displaceable piston guide (11) with a cartridge chamber (13) and a guide channel for receiving and guiding a strip-shaped cartridge magazine (15) that opens into a discharge opening (4) in the housing (1). A length (L) extends between a setting-side inside wall of the discharge opening (4) and a setting-side front face (18) of the firing device (10) in the starting position so that a used cartridge magazine (15) can assume an inclined position relative to the longitudinal axis of the guide channel, after the last cartridge is fired. The length (L) is initially between 15 mm to 20 mm and then a length that corresponds to the greatest path by which the firing device (10) can be displaced.

7 Claims, 1 Drawing Sheet

SETTING TOOL

BACKGROUND OF THE INVENTION

The invention relates to a setting tool comprising a housing, a handle projecting laterally from the housing, an actuator switch, a firing device, a piston guide with a cartridge chamber and a guide channel for feeding and guiding a strip-shaped cartridge magazine to the cartridge chamber. The guide channel opens into a discharge opening in the housing. The firing device and the piston guide are displaceable against the force of at least one spring in a direction opposite a setting direction. A length (L) extends between a setting-side inside wall of the discharge opening and a setting-side front face of the firing device in the starting position. Because of the particular design of the discharge opening the used cartridge magazine can bend towards the housing in an end zone of the setting tool facing away from the setting direction. The inclined position indicates to the user that the user must insert a new cartridge magazine through the handle into the housing of the setting tool.

U.S. Pat. No. 1,239,267 discloses a prior art setting device comprised of a housing and a handle projecting laterally from the housing. An axially displaceable piston guide with a cartridge holder is arranged in the housing of the setting device. Also arranged inside the housing is a trigger device displaceable opposite to the setting direction and against the force of a spring. A guide channel for receiving and guiding a belt-shaped cartridge magazine extends through the handle and through the housing, between the piston guide and the ignition unit. A discharge opening, into which the guide channel opens and through which the spent cartridge magazine can exit the housing, is disposed on a side of the housing situated opposite the handle.

This known setting tool has the disadvantage, however, that the user cannot quickly identify whether all cartridges of the cartridge magazine have already been used. The user can only determine whether all the cartridges have been used by counting all of the used cartridges and comparing the number so determined with the number of cartridges still on the cartridge magazine. In practice, the user will usually realize the depletion of the cartridge magazine only after firing the last cartridge. Specifically, upon pressing the setting tool onto a surface and actuating the actuator switch, the user will find that there are no more cartridges in the magazine. Particularly, in setting tools that are equipped with a magazine holder for strip-type nail magazines having a transport assembly, the conveyor assembly cooperating with the nail magazine must be disengaged on subsequent application and a new cartridge magazine must be used.

SUMMARY OF THE INVENTION

The object of the present invention is to provide a setting tool, in which the strip-shaped cartridge magazine, after the last cartridge is fired, can assume an inclined position relative to the longitudinal axis of the guide channel, that indicates securely and easily, on the display, that a new cartridge magazine must be installed in the setting tool.

This object is achieved by the setting tool of the present invention. The setting tool comprises a housing, a handle projecting laterally from the housing, an actuator switch, a firing device, a piston guide with a cartridge chamber and a guide channel. The guide channel extends perpendicularly to a setting direction through the handle and through the housing, between the firing device and the cartridge magazine. The guide channel feeds and guides a strip-shaped cartridge magazine to the cartridge chamber and opens into a discharge opening in the housing, wherein the discharge opening is arranged on the side of the housing opposite the handle. The firing device and the piston guide are displaceable against the force of at least one spring in a direction opposite the setting direction. A length (L) extends between a setting-side inside wall of the discharge opening and a setting-side front face of the firing device in the starting position. The length (L) is initially between 15 mm to 20 mm and then corresponds to the greatest path by which the firing device (10) can be displaced.

Because of the particular design of the discharge opening the used cartridge magazine can bend towards the housing in an end zone of the setting tool facing away from the setting direction. The inclined position indicates to the user that the user must insert a new cartridge magazine through the handle into the housing of the setting tool.

The used cartridge magazine can lean towards the housing even in the setting end zone of the setting tool. Specifically, the distance between an inside wall of the discharge opening facing away from the setting direction and the front end facing the setting direction of the firing device in the starting position corresponds to least 0.4 times the length between the inside wall of the discharge opening facing, in the setting direction, and the front end of the firing device, on the setting direction side.

The guide channel opening into the discharge opening has a feed zone extending up to the cartridge magazine. A discharge zone is disposed on the feed side. The discharge zone, for example, has a larger cross-section than the feed zone. As a result, the cartridge magazine can assume an inclined position immediately after firing the last cartridge and after removing the setting tool from a surface.

It is beneficial to the user if the cartridge magazine can incline not only laterally on a plane extending parallel to the setting direction but also on a plane extending perpendicular to the setting direction. To make this arrangement possible, the width of the discharge opening extending perpendicular to the setting direction corresponds to 0.6 to 1.2 times the length between the inside wall, of the discharge opening facing in the setting direction, and the front end of the firing device, on the setting side.

The inclined cartridge magazine lies flat in the peripheral zone of the discharge opening. Preferably, the discharge opening widens towards the outer contour of the housing. Such a widening discharge opening can be disposed, advantageously, at the end zones that define the extension of the discharge opening, in at least one of a direction running parallel to the setting direction and at the lateral zones defining the greatest width of the discharge opening. The widening zones are designed as surfaces, at an incline to the longitudinal axis of the guide channel, on which the cartridge magazine can rest.

There will be sufficient inclination of the cartridge magazine if the discharge opening preferably widens at less that a total angle of 30° to 100°.

The discharge opening can be closed at least partly with a cover that forms a chippings shield and can securely retain the used and inclined disposed cartridge magazine, on a ceiling, so that it does not fall onto the user. If the cover, for example, covers the entire discharge opening, then the cover has at least one passage for the cartridge magazine. The cover is at least partially constructed of an elastic or resilient material, such as rubber. It is also possible to provide the peripheral zone of the passage with soft bristles that can be in lateral contact with the cartridge magazine.

Other features and advantages of the present invention will become more apparent from the following description of the invention which refers to the accompanying drawings.

DETAILED DESCRIPTION OF THE INVENTION

Figure 1:
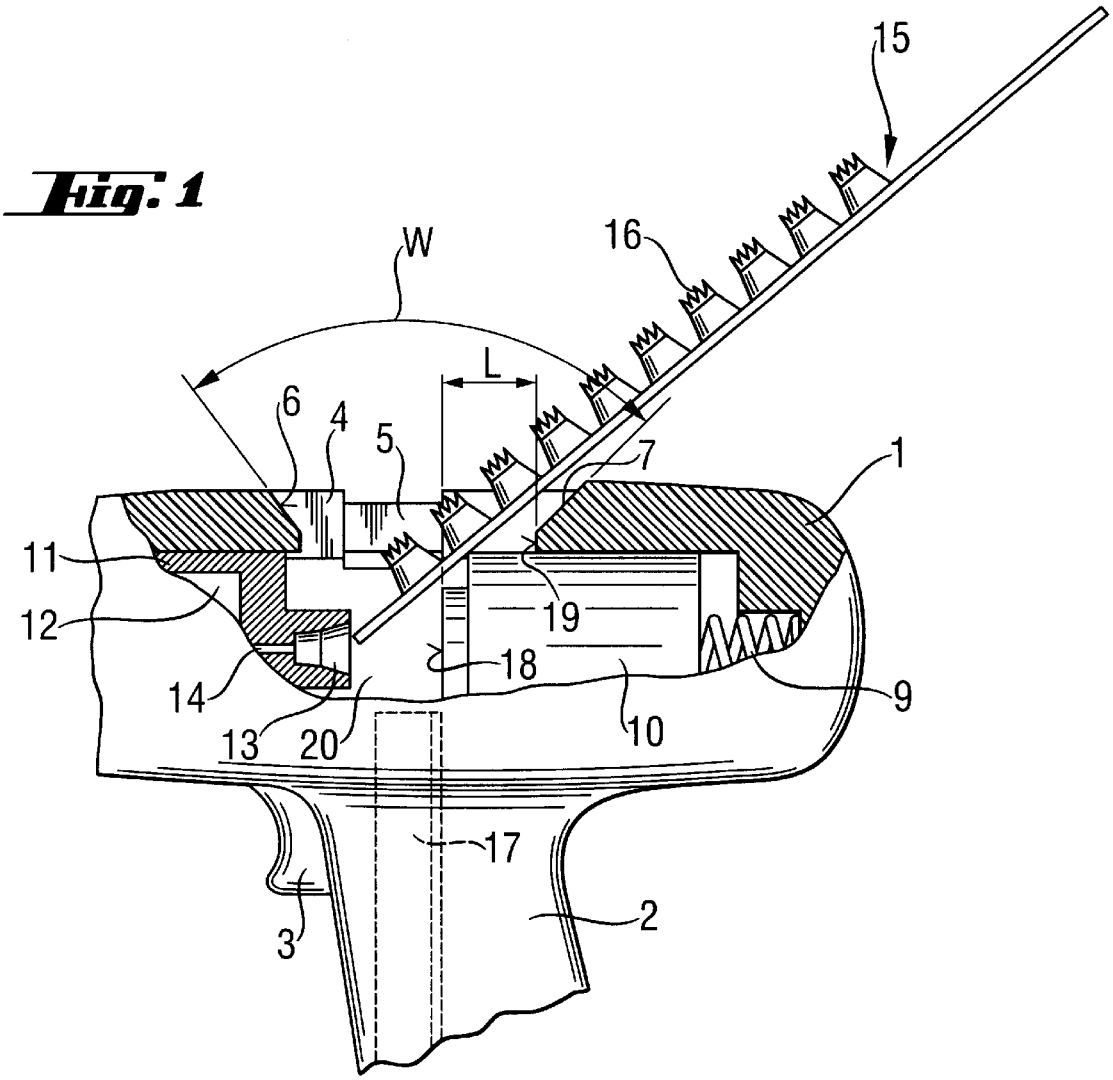
FIG. 1 illustrates a partial sectional representation of the setting tool with a strip-shaped cartridge magazine, in accordance with the invention.
Figure 2:
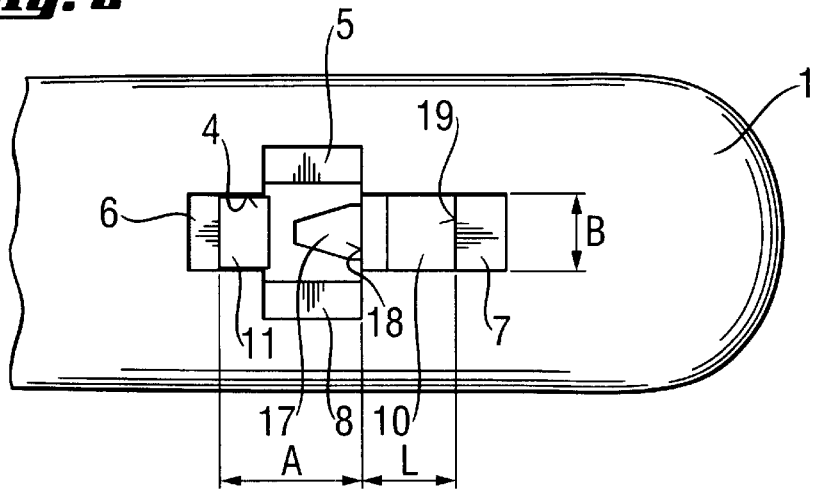
FIG. 2 illustrates a top view of the representation of the setting tool illustrated in FIG. without the strip-shaped cartridge magazine.

FIGS. 1 and 2 illustrate a partial sectional representation of the setting tool of the present invention. The illustrated partial representation of the setting tool comprises a housing 1, a handle 2 projecting laterally from the housing 1, an actuation switch 3, a piston guide 11 and a firing device 10. The handle 2 projects perpendicularly from the housing 1. The actuation switch 3 is located on the setting side of the handle 2, in a transitional zone between the housing 1 and the handle 2. The piston guide 11 and the firing device 10 are disposed co-axially to each other and are arranged on the housing 1.

The piston guide 11 and the ignition device 10 are each displaceable opposite the setting direction and against the force of at least one spring 9. In an end zone facing away from the setting direction the piston guide 11 has a cartridge magazine 13 that tapers in the setting direction. The cartridge magazine is in communication with a combustion chamber 12 of the piston guide 11 via a connecting channel 14.

A guide channel extends perpendicular to the setting direction through the handle 2 and through the housing 1, between the piston guide 11 and the firing device 10. A feed zone 17 of the guide channel receives and guides a strip-shaped cartridge magazine 15. A discharge opening 20 adjoins the feed side. The discharge zone opens into a discharge opening in the housing 1, wherein the opening is situated on a side of the setting tool opposite the handle 2. The supply zone 17 extends essentially from the free end of the handle 2 to the area of the cartridge magazine 13.

A length L extends between an inside wall 19, of the discharge opening 4 facing in the setting direction, and a setting side front face 18, of the firing device 10, in the starting position. The length L has an initial length of 15 mm to 10 mm and a second length that corresponds to the greatest path that the firing device 10 can be displaced. A distance A between an inside wall of the discharge opening facing away from the setting side and a setting side front face 18 of the firing device 10 in the starting position corresponds to at least 0.4 times the length L.

A width B of the discharge opening 4 extends perpendicular to the setting direction, as illustrated in FIG. 2. The width B corresponds to 0.6 to 1.2 times the length L. The discharge opening 4 has its greatest width in the medial, central zone of the discharge opening.

The discharge opening 4 widens towards the external contour of the housing 1 at less than an overall angle W of 90°. Zones widening towards the external contour of the housing 1 are found at the end zones 6, 7, which define the extent of the discharge opening 4, in a direction running parallel to the setting direction.

Other expanding zones are formed by the lateral zones 5, 8 that define width B of the discharge opening 4 in the central zone of the discharge opening 4.

The illustrated setting tool is in the starting position after a final cartridge 16 of the cartridge magazine 15 was fired. The piston guide 11 and the firing device 10 are in the starting position and the cartridge magazine 15 is in the inclined position relative to the longitudinal axis 18 of the guide channel. The inclined position indicates to the user that a new cartridge magazine 15 must be inserted into the guide channel of the setting tool.

What is claimed is:

1. A setting tool comprised of a housing (1), a handle (2) projecting laterally from the housing (1), an actuator switch (3), a firing device (10), a piston guide (11) with a cartridge chamber (13) and a guide channel, the guide channel extending perpendicularly to a setting direction through the handle (2) and through the housing (1), between the firing device (10) and the cartridge magazine (13), the guide channel feeding a strip-shaped cartridge magazine (15) to the cartridge chamber (13) and opening into a discharge opening (4) in the housing (1), the discharge opening being arranged on the side of the housing (1) opposite handle (2), the firing device (10) and the piston guide (11) being displaceable against the force of at least one spring (9) in a direction opposite the setting direction, wherein a length (L) extends between a setting-side inside wall of the discharge opening (4) and a setting-side front face (18) of the firing device (10) in the starting position, the length (L) being initially between 15 mm to 20 mm and then corresponding to the greatest path by which the firing device (10) can be displaced.

2. The setting tool of claim 1, wherein a distance (A) between an inside wall of the discharge opening (4) facing away from the setting side and the setting-side front face (18) of the firing device (10) in the starting position corresponds at least to 0.4 times the length (L) between the setting-side inner wall of the discharge opening (4) and the setting-side front face (18) of the firing device (10).

3. The setting tool of claim 1, wherein the guide channel opening into the discharge opening (4) has a feed zone (17) extending to the cartridge chamber (13) and wherein a discharge zone (20) communicates with the feed zone (17) in the direction of feed.

4. The setting tool of claim 1, wherein a width (B) of the discharge opening (4) extends perpendicular to the setting direction and corresponds to between 0.6 to 1.2 times the length (L) between the setting-side inner wall of the discharge opening (4) and the setting-side front face (18) of the firing device (10).

5. The setting tool of claim 1, wherein the discharge opening (4) expands towards the outer contour of the housing (1).

6. The setting tool of claim 5, wherein the discharge opening (4) expands towards the outer contour of the housing (1) at the end zones (6, 7) that define the expansion of the discharge opening (4) in at least one of a direction running parallel to the setting direction and lateral zones (5, 8) defining the greatest width (B) of the discharge opening.

7. The setting tool of claim 5, wherein the discharge opening (4) expands to an angle (W) of between 30° to 100°.

* * * * *